US009586087B1

(12) United States Patent
Lin

(10) Patent No.: US 9,586,087 B1
(45) Date of Patent: Mar. 7, 2017

(54) STEPPING EXERCISE MACHINE

(71) Applicant: Ching-I Lin, Taoyuan (TW)

(72) Inventor: Wen-Te Lin, Tainan (TW)

( * ) Notice: Subject to any disclaimer, the term of this patent is extended or adjusted under 35 U.S.C. 154(b) by 0 days.

(21) Appl. No.: 14/940,788

(22) Filed: Nov. 13, 2015

(51) Int. Cl.
*A63B 22/04* (2006.01)
*A63B 22/06* (2006.01)
*A63B 22/00* (2006.01)

(52) U.S. Cl.
CPC ..... *A63B 22/0664* (2013.01); *A63B 22/001* (2013.01)

(58) Field of Classification Search
CPC ..... A63B 22/0664; A63B 22/001; A63B 2022/0038; A63B 2022/0043; A63B 2022/0056; A63B 2022/0061
See application file for complete search history.

(56) References Cited

U.S. PATENT DOCUMENTS 5,290,211 A * 3/1994 Stearns ..... A63B 21/00178 482/51
5,577,985 A * 11/1996 Miller ..... A63B 21/00178 482/51
5,800,315 A * 9/1998 Yu ..... A63B 22/0664 482/51
5,924,963 A * 7/1999 Maresh ..... A63B 22/001 482/51
6,837,829 B2 * 1/2005 Eschenbach ..... A63B 22/0005 482/51
6,949,054 B1 * 9/2005 Stearns ..... A63B 22/001 482/52
7,223,209 B2 * 5/2007 Lee ..... A63B 22/001 482/52
7,887,466 B1 * 2/2011 Chen ..... A63B 21/0053 482/54
8,808,148 B2 * 8/2014 Watterson ..... A63B 22/001 482/51
2002/0137601 A1 * 9/2002 Tobias ..... A63B 21/0088 482/52
2008/0274860 A1 * 11/2008 Lee ..... A63B 22/001 482/52
2010/0152000 A1 * 6/2010 Giannelli ..... A63B 22/0056 482/52

* cited by examiner

*Primary Examiner* — Loan H Thanh
*Assistant Examiner* — Megan Anderson
(74) *Attorney, Agent, or Firm* — Lynette Wylle; Apex Juris, pllc

(57) ABSTRACT

A stepping exercise machine has a frame, a transmission assembly, a resistance fan and two stepping assemblies. The frame has a base, a supporting bar, a mounting bracket and an oblique auxiliary bar. The transmission assembly is mounted on the supporting bar of the frame. The resistance fan is mounted rotatably on the transmission assembly and is able to be driven by the transmission assembly to create airflow. The stepping assemblies are mounted on the frame, are connected to the transmission assembly and are able to drive the transmission assembly to rotate the resistance fan. The resistance fan improves exercise intensity of a user.

6 Claims, 7 Drawing Sheets

STEPPING EXERCISE MACHINE

BACKGROUND OF THE INVENTION

1. Field of the Invention

The present invention relates to an exercise machine, and more particularly to a stepping exercise machine that allows a user to do efficient stepping exercise thereon. A resistance fan mounted on the stepping exercise machine is rotated with stepping force derived from the user and creates airflow that exerts an opposite reaction force on the resistance fan, which causes a resistance against the user and improves the user's workout efficiency.

2. Description of Related Art

Moderns live busy lives and are limited by cramped space and bad weather, which causes most of them do less exercise than required for health. Therefore, lots of exercise product manufacturers have developed various stationary bicycles, treadmills, stepping machines for people to exercise indoors without be restricted by space and weather.

To overcome the shortcomings, the present invention provides a stepping exercise machine to mitigate or obviate the aforementioned problems.

SUMMARY OF THE INVENTION

The main objective of the invention is to provide a stepping exercise machine that allows a user to do efficient stepping exercise thereon. A resistance fan mounted on the stepping exercise machine is rotated with stepping force derived from the user and creates airflow that exerts an opposite reaction force on the resistance fan, which causes a resistance against the user and improves the user's workout efficiency.

A stepping exercise machine in accordance with the present invention has a frame, a transmission assembly, a resistance fan and two stepping assemblies. The frame has a base, a supporting bar, a mounting bracket and an oblique auxiliary bar. The transmission assembly is mounted on the supporting bar of the frame. The resistance fan is mounted rotatably on the transmission assembly and is able to be driven by the transmission assembly to create airflow. The stepping assemblies are mounted on the frame, are connected to the transmission assembly and are able to drive the transmission assembly to rotate the resistance fan. The resistance fan improves exercise intensity of a user.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
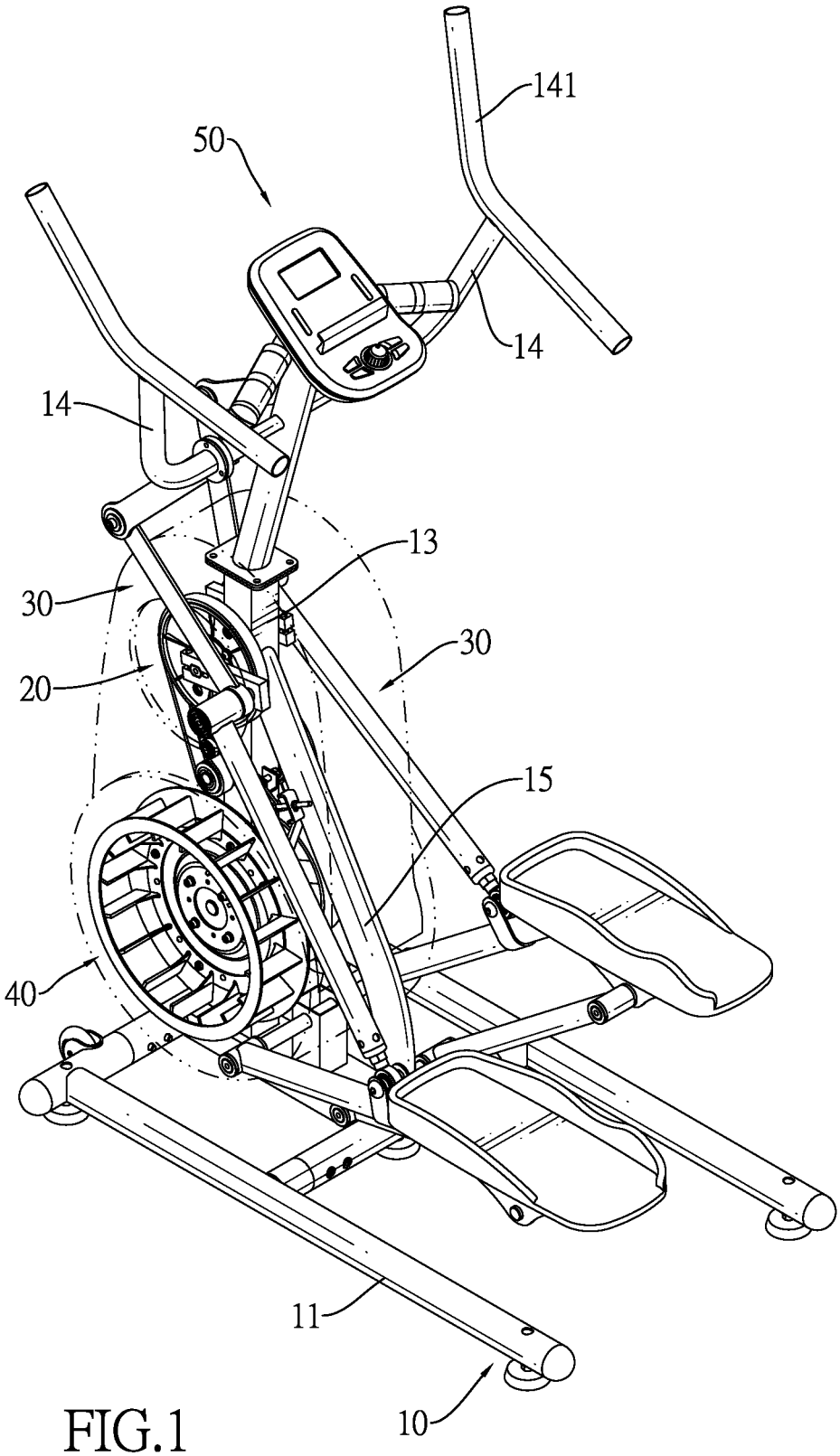
FIG. 1 is a perspective view of a stepping exercise machine in accordance with the present invention.
Figure 2:
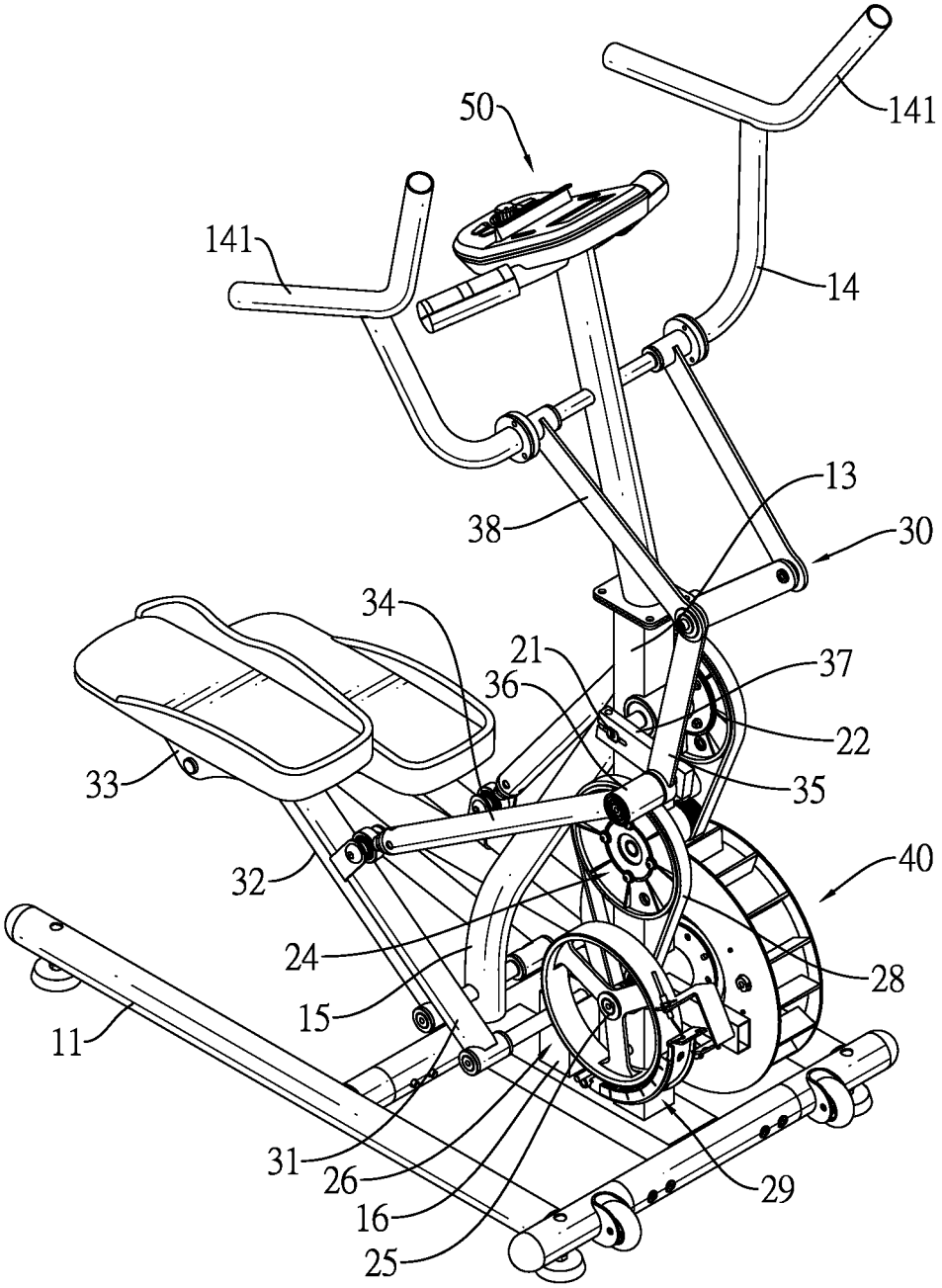
FIG. 2 is another perspective view of the stepping exercise machine in FIG. 1.
Figure 3:
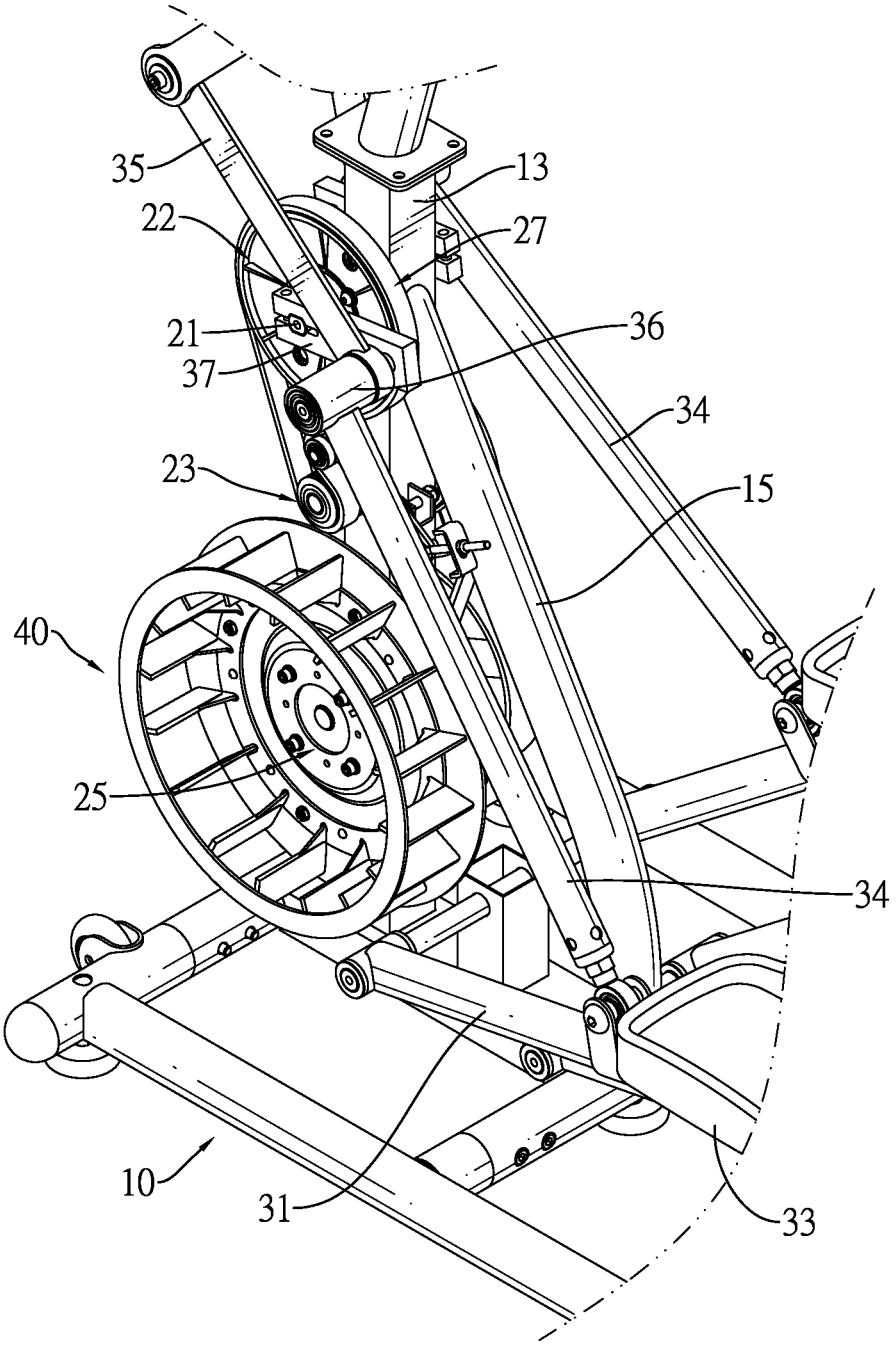
FIG. 3 is an enlarged perspective view of the stepping exercise machine in FIG. 1.

With reference to FIGS. 1 to 3, a stepping exercise machine in accordance with the present invention comprises a frame 10, a transmission assembly 20, a resistance fan 40, two stepping assemblies 30 and a control panel 50.

Figure 4:
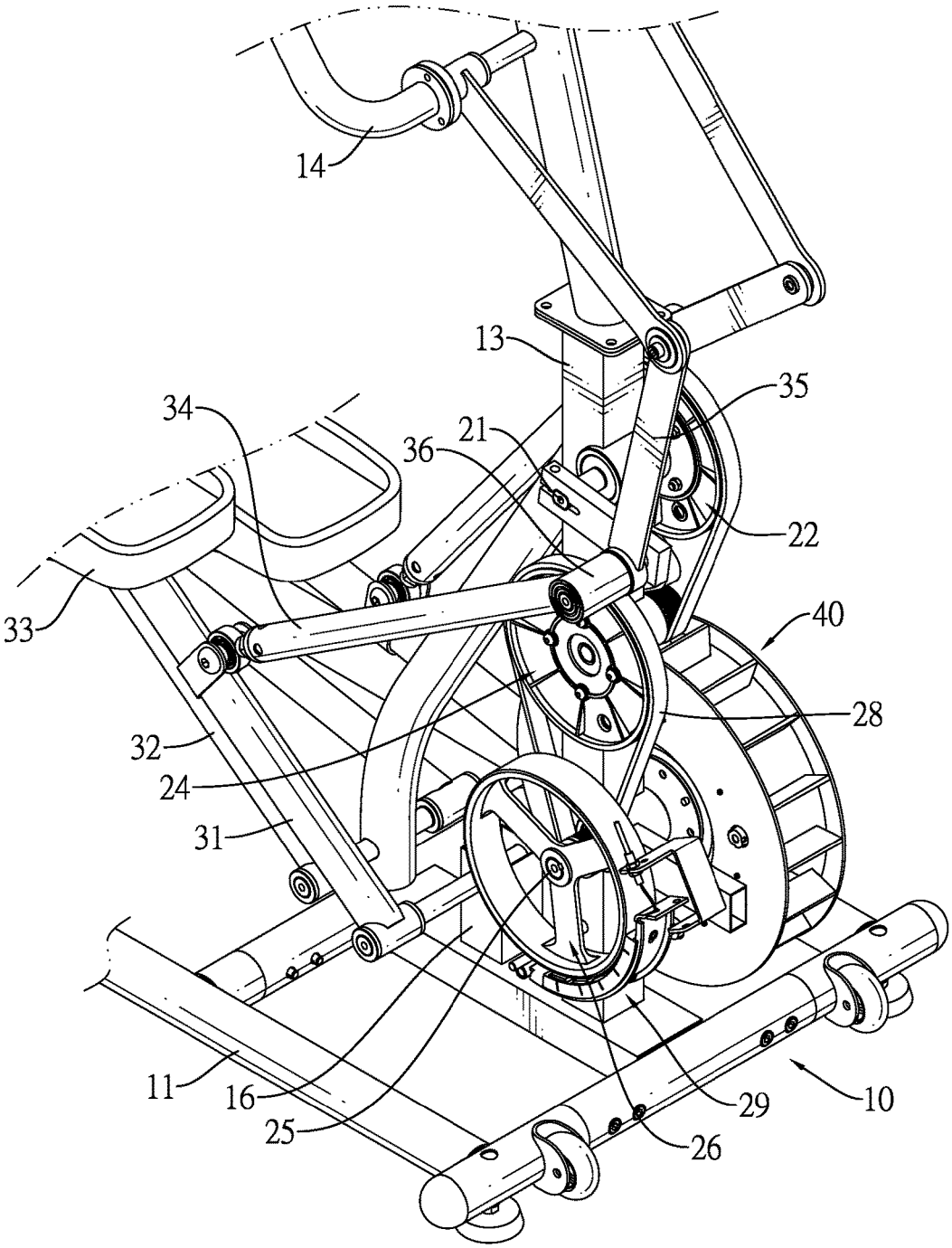
FIG. 4 is another enlarged perspective view of the stepping exercise machine in FIG. 2.
Figure 5:
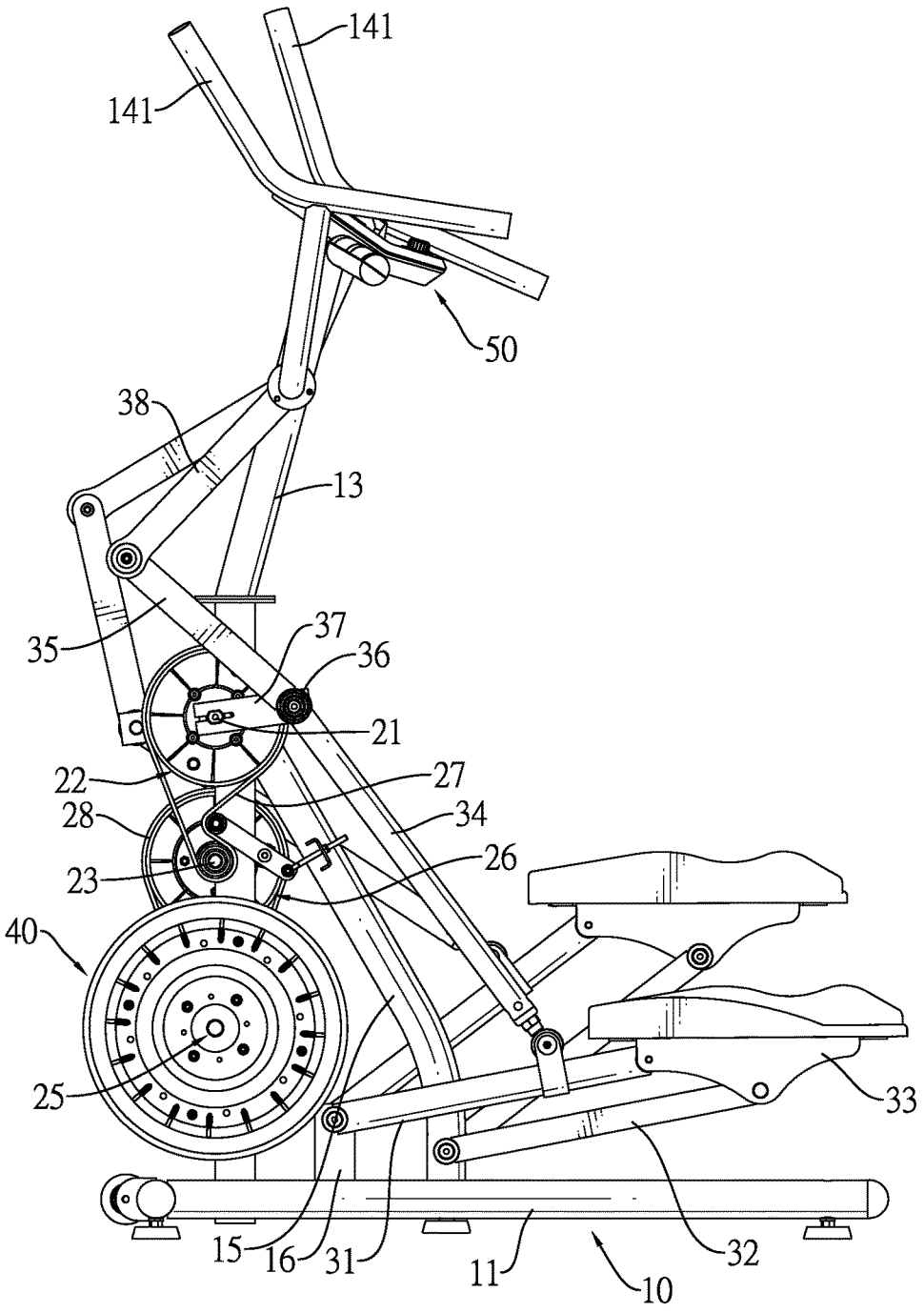
FIG. 5 is a side view of the stepping exercise machine in FIG. 1.
Figure 6:
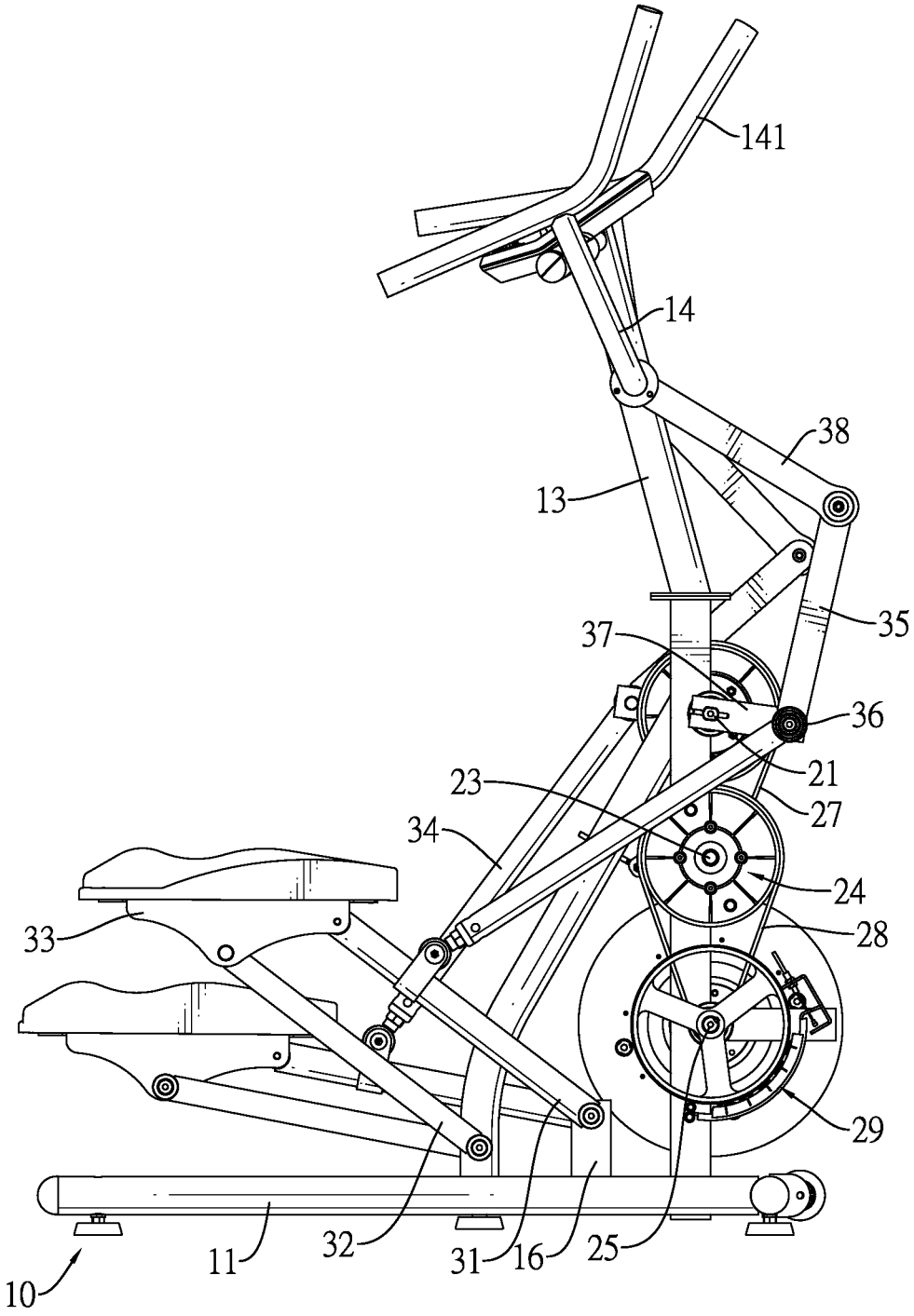
FIG. 6 is another side view of the stepping exercise machine in FIG. 1.
Figure 7:
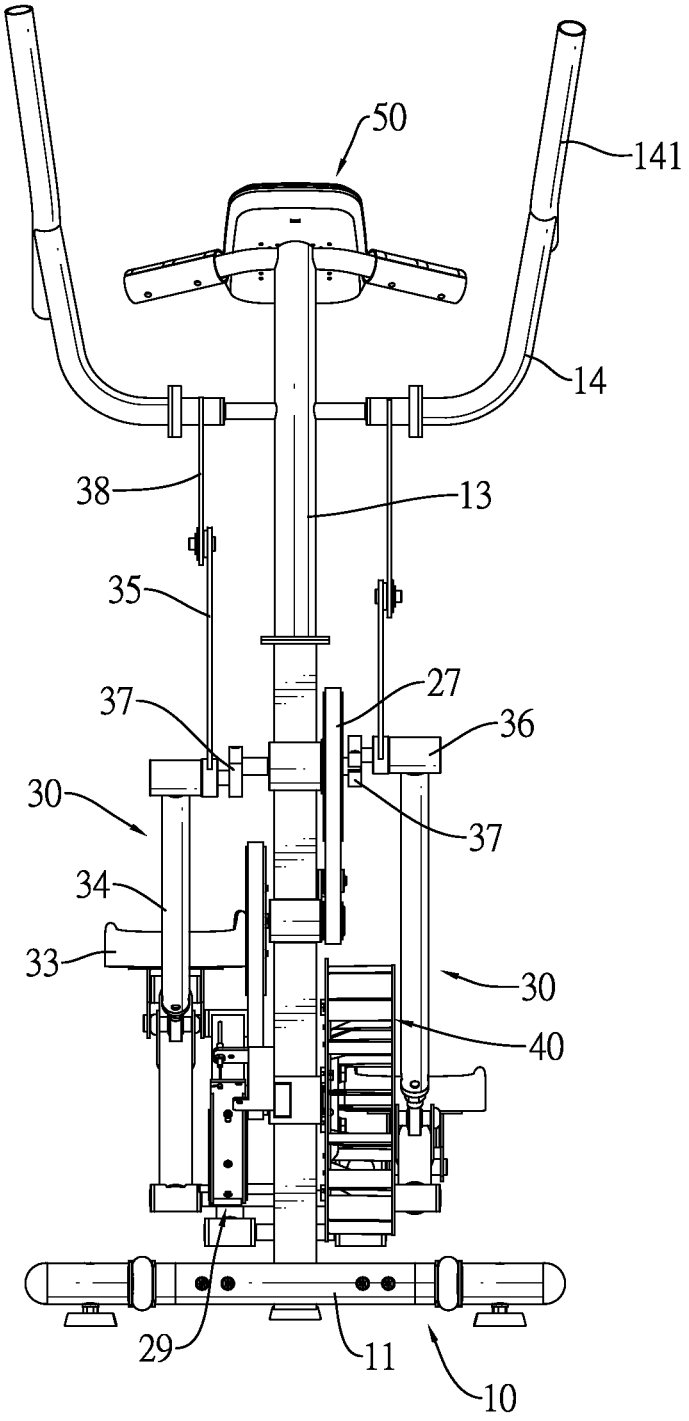
FIG. 7 is a front view of the stepping exercise machine in FIG. 1.

With further reference to FIGS. 4 to 6, the frame 10 has a base 11, a supporting bar 13, a mounting bracket 16, an oblique auxiliary bar 15 and a handlebar 14.

The supporting bar is mounted uprightly on the base 11.

The mounting bracket 16 is mounted on the base 11.

The oblique auxiliary bar 15 is mounted between the base 11 and the supporting bar 13 and has two ends connected respectively to the base 11 and the supporting bar 13.

The handlebar 14 is U-shaped, is mounted on a top end of the supporting bar 13 and has two handles 141 formed on two ends of the handlebar 14.

The transmission assembly 20 is mounted on the supporting bar 13 of the frame 10 and has a first shaft 21, a drive wheel 22, a second shaft 23, a driven wheel 24, a third shaft 25, a resistance wheel 26, a first transmission belt 27, a second transmission belt 28 and a magnetic element 29.

The first shaft 21 is mounted rotatably on the supporting bar 13.

The drive wheel 22 is mounted securely on the first shaft 21.

The second shaft 23 is mounted rotatably on the supporting bar 13.

The driven wheel 24 is mounted securely on the second shaft 23.

The third shaft 25 is mounted rotatably on the supporting bar 13.

The resistance wheel 26 may be made of metal and is mounted securely on the third shaft 25.

The first transmission belt 27 is mounted around the drive wheel 22 and the second shaft 23.

The second transmission belt 28 is mounted around the driven wheel 24 and the third shaft 25.

The magnetic element 29 is mounted on the frame 10, is disposed near the resistance wheel 26 and exerts magnetic attractive force on the resistance wheel 26. Moving the magnetic element 29 toward or backward from resistance wheel 26 increases or decreases the magnetic attractive force to the resistance wheel 26.

The resistance fan 40 is mounted rotatably on the transmission assembly 20 and is able to be driven by the transmission assembly 20 to create airflow. Preferably, the resistance fan 40 is mounted on the third shaft 25 and is capable of rotating synchronously with the resistance wheel 20.

The stepping assemblies 30 are mounted on the frame 10, are connected to the transmission assembly 20 and are able to drive the transmission assembly 20 to rotate the resistance fan 40. The rotating resistance fan 40 creates airflow that exerts an opposite reaction force on the resistance fan, which causes a resistance against the user and improves the user's workout efficiency.

With further reference to FIGS. 4 to 7, each stepping assembly 30 has a first connection bar 31, a second connection bar 32, a foot pedal 33, a linking bar 34, a first linkage arm 35, a linkage shaft 36, a crank 37 and a second linkage arm 38.

The first connection bar 31 has two ends and one end of the first connection bar 31 is mounted pivotally on the mounting bracket 16.

The second connection bar 32 is disposed to be parallel to the first connection bar 31 and has two ends. One end of the second connection bar 32 is mounted pivotally on the oblique auxiliary bar 15.

The foot pedal 33 is mounted pivotally on the other end of the first connection bar 31 and the other end of the second connection bar 32.

The linking bar 34 has two ends. One end of the linking bar 34 is mounted pivotally on the first connection bar 31 and the other end of the linking bar 34 is mounted pivotally on the transmission assembly 20.

The first linkage arm 35 has two ends. One end of the first linkage arm 35 is mounted pivotally on one end of the linking bar 34.

The linkage shaft 36 is mounted rotatably on the other end of the first linkage arm 35.

The crank 37 has two ends. One end of the crank 37 is mounted pivotally one the linkage shaft 36 and the other of the crank 37 is mounted securely on the first shaft 21.

The second linkage arm 38 has two ends. One end of the second linkage arm 38 is mounted pivotally on the first linkage arm 35 and the other end of the second linkage arm 38 is mounted on the handlebar 14.

The control panel 50 is mounted securely on the handlebar 14 and allows a user to operate the control panel 50 to monitor stepping rate, heart beat rate, etc.

When the user exercises on the stepping assemblies 30 of the stepping exercise machine, the foot pedals 33 are driven to along an upstairs or downstairs path. The moving stepping assemblies 30 drive the transmission assembly 20 and further rotate the resistance fan 40.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A stepping exercise machine comprising:

a frame having a base;

a supporting bar mounted uprightly on the base;

a mounting bracket mounted on the base;

an oblique auxiliary bar mounted between the base and the supporting bar and having two ends connected respectively to the base and the supporting bar; and a handlebar mounted on a top end of the supporting bar;

a transmission assembly mounted on the supporting bar of the frame;

a resistance fan mounted rotatably on the transmission assembly and being able to be driven by the transmission assembly to create airflow; and two stepping assemblies mounted on the frame, connected to the transmission assembly, and being able to drive the transmission assembly to rotate the resistance fan, wherein each stepping assembly having a first connection bar having two ends, and one end of the first connection bar mounted pivotally on the mounting bracket;

a second connection bar disposed to be parallel to the first connection bar and having two ends, and one end of the second connection bar mounted pivotally on the oblique auxiliary bar;

a foot pedal mounted pivotally on the other end of the first connection bar and the other end of the second connection bar; and a linking bar having two ends, one end of the linking bar mounted pivotally on the first connection bar, and the other end of the linking bar mounted pivotally on the transmission assembly.

2. The stepping exercise machine as claimed in claim 1, wherein the transmission has a first shaft mounted rotatably on the supporting bar;

a drive wheel mounted securely on the first shaft;

a second shaft mounted rotatably on the supporting bar;

a driven wheel mounted securely on the second shaft;

a third shaft mounted rotatably on the supporting bar;

a resistance wheel mounted securely on the third shaft;

a first transmission belt mounted around the drive wheel and the second shaft; and a second transmission belt mounted around the driven wheel and the third shaft.

3. The stepping exercise machine as claimed in claim 2, wherein each stepping assembly further has a first linkage arm having two ends, and one end of the first linkage arm mounted pivotally on the other end of the linking bar;

a linkage shaft mounted rotatably on the other end of the first linkage arm;

a crank having two ends, one end of the crank mounted pivotally one the linkage shaft, and the other of the crank mounted securely on the first shaft; and a second linkage arm having two ends, one end of the second linkage arm mounted pivotally on the first linkage arm, and the other end of the second linkage arm mounted on the handlebar.

4. The stepping exercise machine as claimed in claim 3, wherein the handlebar has two handles, wherein each handle is formed on an end of the handlebar.

5. The stepping exercise machine as claimed in claim 4, wherein a control panel is mounted securely on the handlebar.

6. The stepping exercise machine as claimed in claim 5, wherein the transmission assembly further has a magnetic element mounted on the frame, disposed near the resistance wheel and exerting magnetic attractive force on the resistance wheel; and moving the magnetic element toward or backward from resistance wheel increases or decreases the magnetic attractive force to the resistance wheel.

* * * * *